US005991927A

United States Patent [19]

Barbaccia

[11] Patent Number: 5,991,927

[45] Date of Patent: Nov. 30, 1999

[54] SHAPING DEVICES FOR BILL OF A CAP

[76] Inventor: Maria Terese Barbaccia, 20821 National La., Huntington Beach, Calif. 92646

[21] Appl. No.: 09/111,283

[22] Filed: Jul. 6, 1998

[51] Int. Cl.[6] ..... A42B 1/24

[52] U.S. Cl. ..... 2/209.13; 2/244; 40/329; 223/84

[58] Field of Search ..... 2/209.13, 244, 2/195.1; 223/12, 14, 24, 66, 84; 40/329

[56] References Cited

U.S. PATENT DOCUMENTS 5,410,761 5/1995 Connelly et al. ..... 2/209.13
5,452,479 9/1995 Mostert ..... 2/209.13
5,533,652 7/1996 Levin ..... 223/84
5,685,465 11/1997 Berardis ..... 223/84

OTHER PUBLICATIONS

Drawing of device allegedly seen on 60 minutes on Sunday, May 31, 1998; hosted by Andy Rooney.

*Primary Examiner*—Diana Oleksa
*Attorney, Agent, or Firm*—Eric Karich

[57] ABSTRACT

A shaping device has a bill-shaping wall with a bill locking portion at each of its first and second terminal ends. The bill of the cap fits into the shaping device such that the bill locking portions frictionally hold the bill against the bill-shaping wall, thereby shaping the bill into the shape of the bill-shaping wall. The bill-support wall preferably further includes indicia of team enthusiasm and loyalty and a transparent plastic card-holder for storing and displaying a baseball card.

2 Claims, 1 Drawing Sheet

SHAPING DEVICES FOR BILL OF A CAP

BACKGROUND OF THE INVENTION

1. Field of the Invention

This invention relates generally to cap holding devices, and more particularly to a cap holding device that curls the bill of the cap into a desired shape.

2. Description of Related Art

When a user first purchases a cap, the bill of the cap is generally flat. Since it is not generally considered aesthetically pleasing to wear a cap with a flat bill, it is necessary for the user to shape the bill of the cap into a curl. Shaping the bill into the necessary curl by hand is tedious and the bill will later lose its shape if the cap is simply placed in storage or on a hat rack.

In addition to giving a cap a proper curl, many cap collectors and enthusiasts like to display their caps on a shelf or in a display case. While displaying the caps, it is desirable to associate with the cap various indicia of enthusiasm and loyalty to the team or a specific player.

The current invention provides a device that meets both of these requirements. The device removably engages the bill of the cap, thereby shaping the bill of the cap into the desired shape. The device also provides various indicia that turn a simple cap into a showcase for team enthusiasm and spirit.

SUMMARY OF THE INVENTION

The present invention teaches certain benefits in construction and use which give rise to the objectives described below.

The present invention provides a shaping device for a bill of a cap. The shaping device has a bill-shaping wall with a first and second bill locking portion at its first and second terminal ends, respectively. The bill of the cap fits into the shaping device such that the combination of the first and second bill locking portion frictionally hold the bill against the bill-shaping wall, thereby shaping the bill into the shape of the bill-shaping wall. The bill-support wall preferably further includes indicia of team enthusiasm and loyalty and a transparent plastic card-holder for storing and displaying a baseball card.

A primary objective of the present invention is to provide a shaping device for a bill of a cap, the shaping device having advantages not taught by the prior art.

Another objective is to provide a shaping device that shapes the bill of a cap into a desired, curled shape, as well as maintaining that shape while the cap is storage.

A further objective is to provide a device that stores various indicia of team enthusiasm and loyalty and associates the indicia with the stored cap.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
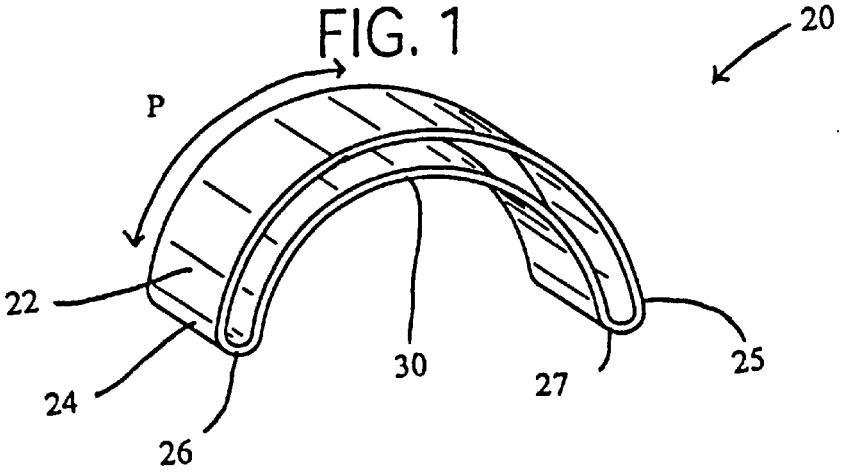
FIG. 1 is a perspective view of the preferred embodiment of the present invention.
Figure 2:
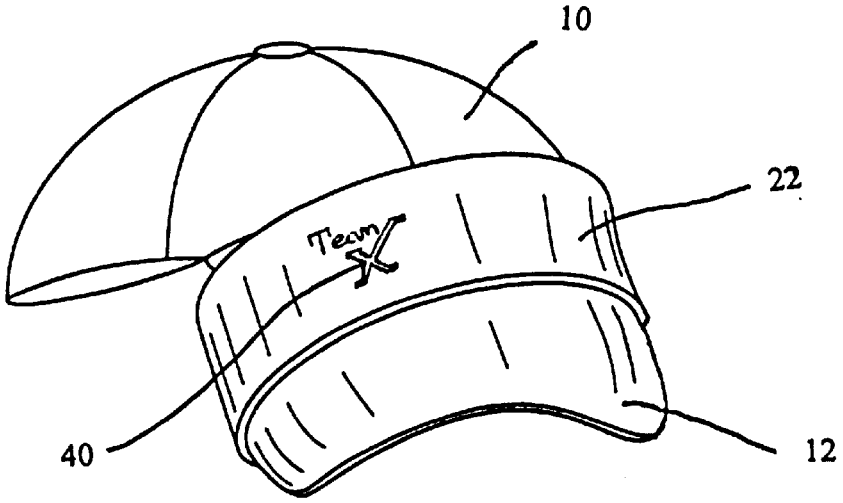
FIG. 2 is a perspective view thereof, showing the invention removably engaged to a baseball cap, and showing the invention having indicia of team enthusiasm.

The above described drawing figures illustrate the invention, a shaping device 20 for a bill 12 of a cap 10. As shown in FIG. 1, the shaping device 20 has a bill-shaping wall 22 with first and second bill locking portion 26 and 27 at the first and second terminal ends 24 and 25, respectively. As shown in FIG. 2, the bill 12 of the cap 10 fits into the shaping device 20 such that the first and second bill locking portion 26 and 27 frictionally hold the bill 12 against the bill-shaping wall 22, thereby shaping the bill 12 into the shape of the bill-shaping wall 22.

As shown in FIG. 1, the bill-shaping wall 22 is preferably a rigid plastic sheet having a cross section that is generally C-shaped. The bill-shaping wall 22 must have a perimeter length P that is approximately equal to the width of the bill 12 of the cap 10. The bill-shaping wall 22 has first and second terminal ends 24 and 25. The first terminal end 24 has a first bill locking portion 26. The second terminal end 25 has a second bill locking portion 27. The first and second bill locking portion 26 and 27 are preferably integral with the first and second terminal ends 24 and 25 of the bill-shaping wall 22, respectively. The first and second bill locking portion 26 and 27 most preferably extend to form a single bill-support wall 30. The bill-support wall 30 is preferably a rigid wall that is generally parallel to the bill-shaping wall 22 and separated therefrom by a distance only slightly greater than the thickness of the bill 12 of the cap 10.

The shaping device 20 is preferably made of a single piece of rigid molded plastic. As shown in FIG. 2, the bill 12 of the cap 10 fits snugly into the shaping device 20 between the upper bill-shaping wall 22 and the lower bill-support wall 30. The first and second bill locking portion 26 and 27 frictionally engage the bill 12 and force the bill 12 against the bill-shaping wall 22. The bill-support wall 30 provides further pressure upwards to force the bill 12 into the proper curled shape. While the user may initially wish to manually shape the cap 10 into the proper curl, storing the cap 10 with its bill 12 in this configuration will tend to permanently shape the bill 12 into the correct curled shape, without the user being forced to manually reshape the bill 12 of the cap 10 after storage.

Figure 3:
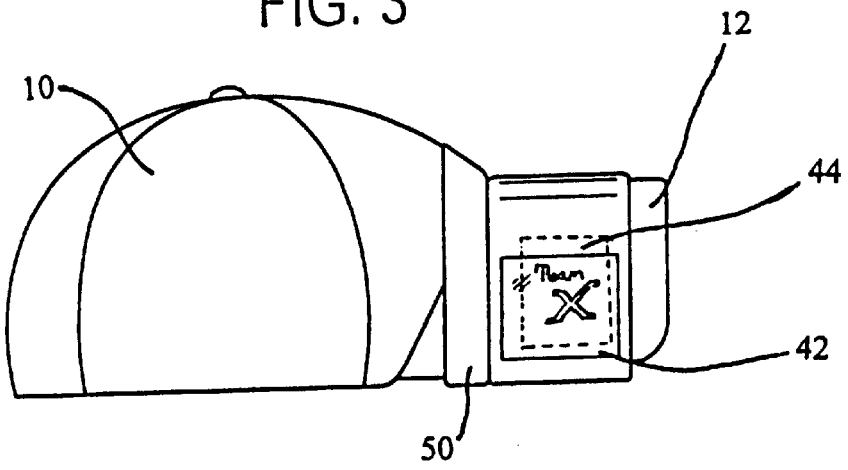
FIG. 3 is a side elevational view thereof, showing other optional features of the invention.

As shown in FIGS. 2 and 3, the most preferred embodiment of the shaping device 20 includes various indicia 40 showing team spirit 40 to compliment the cap 10 being stored in the shaping device 20. An example of such indicia, as shown in FIG. 2, is a team logo painted, etched, or molded into the shaping device 20; or picture or autograph of a favorite team player. In addition, as shown in FIG. 3, another embodiment includes a transparent plastic card-holder 42 for containing and displaying a baseball card 44, or pictures and the like. Such features transform a simple baseball cap 10 into a celebration of a fan's enthusiasm for the sport. FIG. 3 also shows an alternative embodiment wherein the bill-shaping wall 30 further includes an angled rim 50. The angled rim 50 allows the bill-shaping wall 30 to fit the cap 10 more closely, as well as making the shaping device 20 more decorative and aesthetically pleasing.

The invention further includes a method for shaping a bill 12 of a cap 10. The method comprises a plurality of steps. First, providing a cap 10 having a bill 12; and providing a shaping device 20. The shaping device 20 has a rigid bill-shaping wall 22. The bill-shaping wall 22 has a cross section that is generally C-shaped. The bill-shaping wall 22 has a perimeter length P that is approximately equal to the width of the bill 12 of the cap 10. The bill-shaping wall 22 has a first and second terminal end, and the first and second terminal ends 24 and 25 have a first and second bill locking portion 26 and 27, respectively. The bill 12 of the cap 10 is inserted into the shaping device 20 such that the first and second bill locking portion 26 and 27 frictionally hold the bill 12 against the bill-shaping wall 22. By holding the bill 12 against the curved surface of the bill-shaping wall 22, the bill-shaping wall 22 imparts a desired shape to the bill 12.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination cap and shaping device, the combination comprising:

a cap having a bill; and a rigid bill-shaping wall, the bill-shaping wall having a cross section that is generally C-shaped, the bill-shaping wall having a perimeter length that is approximately equal to the width of the bill, the bill-shaping wall having first and second terminal ends, the first and second terminal ends each having a bill locking portion, the bill being positioned against the bill-shaping wall and frictionally held in place by the bill locking portions, the bill-shaping wall thereby shaping the cross-section of the bill into a generally C-shape, the bill-shaping wall further including a transparent display slot for storing and displaying a trading card.

2. A method for shaping a bill of a cap, the method comprising the steps of:

a) providing a cap having a bill;

b) providing a shaping device comprising a rigid bill-shaping wall, the bill-shaping wall having a cross section that is generally C-shaped, the bill-shaping wall having a perimeter length that is approximately equal to the width of the bill of the cap, the bill-shaping wall having first and second terminal ends, the first and second terminal ends each having a bill locking portion, the bill-shaping wall further including a transparent display slot sized for storing and displaying a trading card;

c) inserting the bill of the cap into the shaping device such that the bill locking portions frictionally hold the bill against the bill-shaping wall;

d) inserting into the transparent display slot a trading card; and e) displaying the shaping device and trading card with the associated cap.

* * * * *